US007101159B2

(12) United States Patent
Zackl

(10) Patent No.: US 7,101,159 B2
(45) Date of Patent: Sep. 5, 2006

(54) VALVELESS PUMP

(76) Inventor: Wilhelm Zackl, Dreiföhrenstrasse 28., 3040 Neulengbach (AT)

( * ) Notice: Subject to any disclaimer, the term of this patent is extended or adjusted under 35 U.S.C. 154(b) by 0 days.

(21) Appl. No.: 10/493,205

(22) PCT Filed: Oct. 21, 2002

(86) PCT No.: PCT/AT02/00299

§ 371 (c)(1),
(2), (4) Date: Aug. 5, 2004

(87) PCT Pub. No.: WO03/036098

PCT Pub. Date: May 1, 2003

(65) Prior Publication Data

US 2005/0031474 A1 Feb. 10, 2005

(30) Foreign Application Priority Data

Oct. 23, 2001 (AT) ..... A 1687/2001

(51) Int. Cl.
*F04B 19/00* (2006.01)

(52) U.S. Cl. ..... 417/436

(58) Field of Classification Search ..... 417/436
See application file for complete search history.

(56) References Cited

U.S. PATENT DOCUMENTS 3,620,651 A * 11/1971 Hufton ..... 417/436
3,902,083 A 8/1975 Zoltan
5,270,484 A 12/1993 Hiroaki et al.
2003/0021707 A1* 1/2003 Doig ..... 417/413.1

FOREIGN PATENT DOCUMENTS

DE 956 020 1/1957
WO WO 00 62838 10/2000

* cited by examiner

*Primary Examiner*—Charles G. Freay
(74) *Attorney, Agent, or Firm*—Young & Thompson

(57) ABSTRACT

The invention relates to a pump which comprises a tube (4) through which a fluid is delivered, and a device (2) for producing transverse oscillations in the fluid. On the inlet side (5), the tube (4) has a first section (1) with an invariable delivery cross-section and on the outlet side (6) a second section (3) with a variable delivery cross-section. The inventive pump functions according to the following principle: the fluid, when induced to oscillate, performs transverse oscillations in the second section (3) with the variable delivery cross-section and can thereby expand or flow in said oscillating system, while in the first section (1) with the invariable delivery cross-section the fluid oscillates not at all or only to a much lesser extent depending on the compressibility of the medium. The waves caused by the oscillation produced in the fluid therefore substantially expand in the direction of the second section (3) with the variable delivery cross-section so that the fluid inevitably flows from the first section (1) to the second section (3).

4 Claims, 2 Drawing Sheets

VALVELESS PUMP

BACKGROUND OF THE INVENTION

The invention relates to a pump with a pipe through which fluid is conveyed, the pipe on the inlet side having a first segment with a delivery cross section which cannot be changed, and with a means for producing transverse oscillations in the fluid.

In pumps the fluid to be delivered is conventionally conveyed via translationally moved parts, for example, pistons, or rotationally moving pump wheels. Pumping fluids by displacement of the fluid in a deformable tube, for example by squeezing the tube together, is also known.

These known pumps except for the latter type of pump have the disadvantage that in the area of the fluid to be conveyed wear phenomena and possibly contamination of the fluid arise due to the components sliding against one another, or seal problems must be solved. Nor is it easily possible to convey for example sludges with coarse portions, for example, stones, by rotating parts or valves.

U.S. Pat. No. 2,888,877 and DE 956 020 C disclose pumps which on the inlet side have a rigid pipe. Furthermore there are pump devices. In U.S. Pat. No. 2,888,877 this is a sine wave-shaped element and in DE 956 020 C a piston or an elastic pipe piece which can be squeezed together. In U.S. Pat. No. 2,888,877 the pump action takes place by the cross section of the pipe always being closed at one point by the sine wave-shaped element and repeated, progressive motion of this point producing the pump action. In DE 956 020 C the pump action takes place by different friction resistances and inertial forces in the two pipe sections with different diameters.

WO 00/62838 A2 describes a pump in which on either side of a middle segment in which the pump action is produced by the external action of a force there are elastically deformable pipe or tube sections. The varied elasticity behavior of these two segments results in different pressures in these segments so that in the elastic contraction of the two segments pump action in one direction or the other takes place. On either side, any, i.e. both rigid and also elastic pipes, can be connected to the two elastic segments.

Therefore the object of the invention is to make available a pump which avoids the described disadvantages as much as possible.

SUMMARY OF THE INVENTION

The pump as claimed in the invention works according to the principle that the fluid, when it is caused to oscillate, can execute transverse oscillations in the second segment with the variable delivery cross section and in this way can flow or propagate in this oscillatory system, conversely in the first section with the delivery cross section which cannot be changed an oscillation does not take place depending on the compressibility of the medium or does take place only to a much smaller extent. The waves of the oscillation produced in the fluid will propagate therefore largely in the direction of the second segment with the variable delivery cross section so that flow of the fluid from the first segment to the second segment necessarily occurs.

The means for producing oscillations in the fluid is ideally located roughly in the connecting area of the first segment to the second segment, there being several possibilities for producing oscillations in the fluid. If especially high demands are not imposed on the purity of the fluid, it becomes possible to use parts which can be moved relative to one another, such as pistons, pipe segments which can move telescopically, or the like. If this assumption does not apply, it becomes possible to induce the fluid to oscillations for example by a piston which acts from the outside on a for example elastically deformable segment of the pipe or a means which widens or narrows the pipe cross section annularly.

With respect to the variable delivery cross section on the one hand it is possible to be able to change the delivery cross section of the second segment to the outside; this for example is the case for hoses or pipes with an elastically expandable wall or an elastically deformable wall section. But it is also possible to change the delivery cross section within the pipe by for example a deformable insert located within the pipe.

One preferred embodiment of the invention is characterized in that the delivery cross section of the second segment has partial cross sections with a delivery cross section which can be changed. The overall cross section of the second segment can be invariable in any cross sectional plane, but the delivery cross section of the partial cross sections can be changed such that the sum of the variable partial cross sections in each cross sectional plane always yields the invariable overall cross section in this cross sectional plane.

BRIEF DESCRIPTION OF THE DRAWINGS

Other features and advantages of the invention result from the following description of embodiments of the invention with reference to the drawings.

DESCRIPTION OF THE PREFERRED EMBODIMENTS

FIGS. 1 to 4 show a first preferred embodiment of a pump as claimed in the invention which consists essentially of a pipe 4 with a first segment 1 with an invariable delivery cross section and a second segment 3 with a variable delivery cross section. The wall of the pipe 4 has an ability to change shape under pressure or the action of oscillations, which ability is negligible within the framework of the invention, but if necessary it can be flexible, as is known for example of hydraulic hoses.

Figure 1:
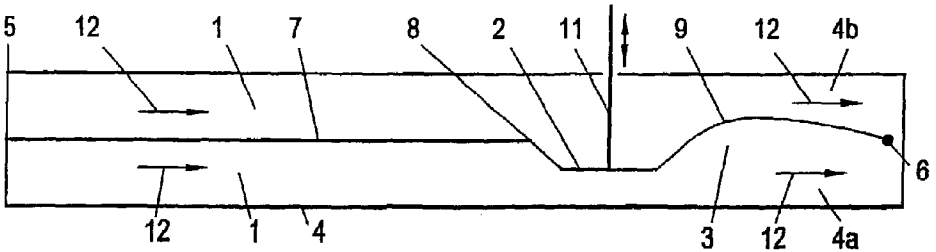
FIG. 1 shows a schematic through a first embodiment of the invention.
Figure 2:
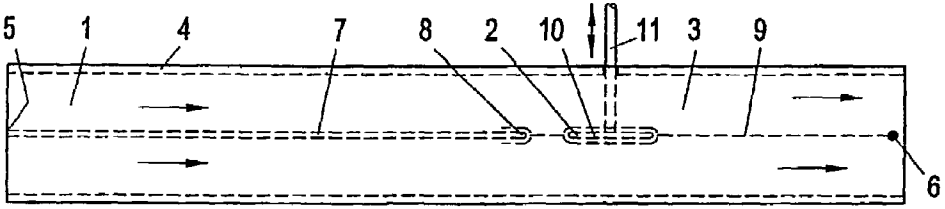
FIG. 2 shows a side view of the embodiment as shown in FIG. 1.
Figure 3:
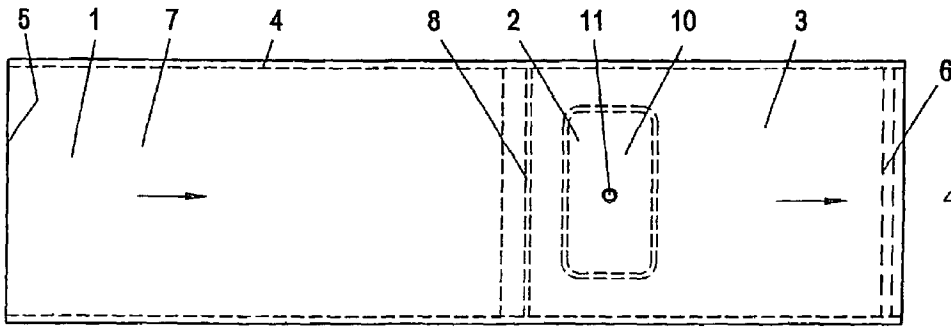
FIG. 3 shows an overhead view of the embodiment from FIG. 2.
Figure 4:
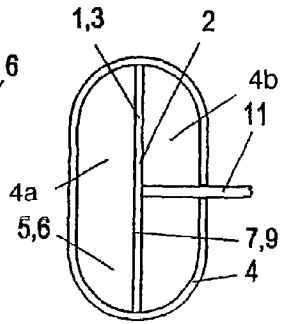
FIG. 4 shows a view in the lengthwise direction of the embodiment from FIG. 3, FIGS. 5 through 9 schematically show other preferred embodiments of the inventions, FIGS. 10 and 11 schematically show the use of the pump as claimed in the invention as a drive, for example for ships, in a side view and an overhead view

The total cross section of the pipe 4 is, as is shown best in FIGS. 1 and 4, divided into partial cross sections 4*a*, 4*b*. This subdivision takes place in the first segment by a rigid partition 7. This rigid partition 7 passes into an elastic membrane at 8. This membrane 9 is acted upon by a means 2 for producing oscillations which has a pressure plate 10 which is attached to the membrane 9, and a piston rod 11 or the like which is driven by any suitable drive means. By moving the pressure plate 10 back and forth the membrane 9 which is attached at 8 and at the pipe outlet is caused to oscillate, as is shown schematically in FIG. 1. The end can also be free. The membrane need be suspended only on at least two sides. The oscillation of the membrane 9 furthermore changes the delivery cross section of the partial cross sections 4*a,* 4*b,* in any case the overall cross section of the pipe 4 remaining unchanged.

Since the waves or vibrations are moved essentially only in the direction of the outlet 6 through the elastic membrane 9, since the first segment 1 of the pipe 4 does not allow significant oscillation of essentially incompressible fluids, flow necessarily arises in the direction of the arrows 12 from the inlet 5 to the outlet 6 of the pipe 4.

Depending on the type of medium to be delivered, the membrane 9 can be either a thin elastic membrane, but also a link chain composed of stable and wearproof plates, when for example fluids with contents which greatly promote wear such as sludge or rubble are to be conveyed.

If necessary, after the outlet 6 a rigid plate or extension can be connected to the membrane 9 in order to prevent as much as possible flow around the edge of the membrane 9 at the outlet 6; this could reduce the efficiency of the pump as claimed in the invention.

Figures 5, 6, 7, 8, 9, 10, 11, 12, 13:
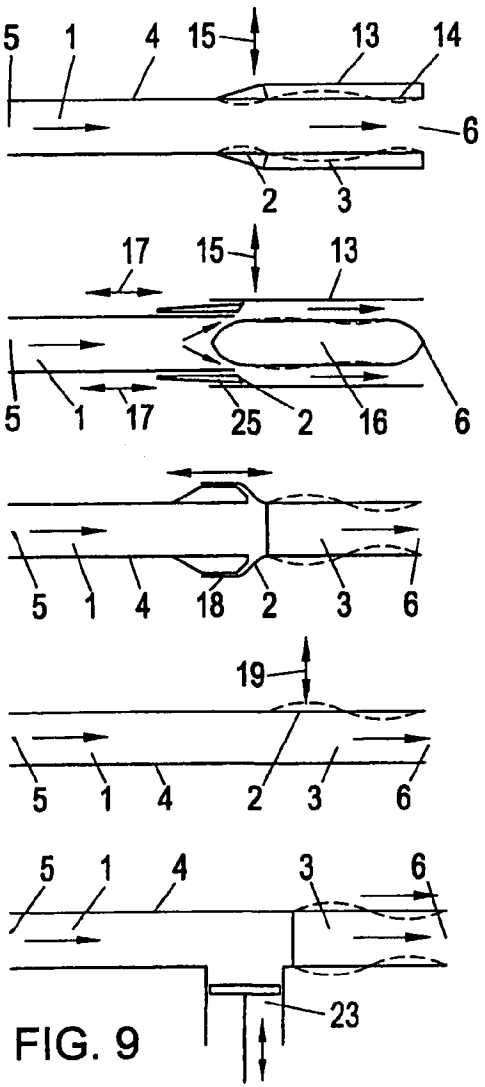
FIGS. 12 and 13 shows other embodiments of the invention.

FIG. 5 shows another embodiment of the pump as claimed in the invention in which the pipe 4 in turn has a first segment 1 with an essentially rigid or compression proof pipe or hose. The second segment 3 consists of a double-walled pipe, the outer pipe wall 13 being rigid, conversely the inner pipe wall 14 being elastic. In the connection area of the second segment 3 to the first segment 1 there is in turn a means 2 for producing the oscillations which can consist of a means which is not detailed and which produces oscillations in the fluid. This can be either a means which as is shown by the arrow 15 mechanically-elastically deforms the transition area, for example via plungers which press on the outside pipe 13 which is elastic in this case. Alternatively it is also possible to pressurize the doubled pipe in the transition area, for example with a pressure sleeve, so that the inside wall 14 in the transition area is pressed periodically to the inside and the fluid is thus displaced into this area so that the oscillation of the inside wall 14 of the pipe, which oscillation is symbolized by the broken line in FIG. 5, is formed.

In the embodiment shown in FIG. 6 the variable delivery cross section of the second segment 3 is formed by a closed, deformable insert 16 being located within the rigid outside pipe 13 and being filled for example with air or another compressible medium. The pipe end of the first segment 1 is held concentrically in the pipe 13, between the pipe 1 of the first segment and the pipe 13 an annular gap being formed in which a sleeve 25 is sealed and supported to be movable. By axially moving the sleeve 25 in the direction of the double arrows 17 in the fluid an oscillation is in turn produced which causes delivery of fluid from the inlet 5 to the outlet 6 of the pipe 4.

In the embodiment shown in FIG. 7 the pipe of the second segment is elastically deformable, in any case in the transition area to the section 1 it has a widening 18 which is rigid. In this widening 18 the pipe end of the first segment is concentrically held. The pipe end of the first segment furthermore in the transition area within the sleeve 18 has an enlarged wall thickness 1 so that upon relative motion of the first segment 1 and the second segment 3 pump motion occurs which in turn causes oscillations in the fluid and subsequently the induced fluid flow from the inlet 5 to the outlet 6.

In the simplified embodiment as shown in FIG. 8 the rigid first segment with an invariable delivery cross section is connected to a second segment 3 with a variable delivery cross section. The pipe 4 could for example have a square, rectangular or elliptical cross sectional shape, one wall, in the embodiment the upper wall of the second segment, being made to be elastically deformable. When a mechanical force is acting periodically on this wall cross section from the outside, as is shown symbolically by the double arrow 19, an oscillation in the fluid and thus a pump action are in turn produced.

FIG. 9 shows an embodiment in which between the first segment 1 and the second segment 3 a type of piston pump 23 is connected which produces the oscillation in the second segment 3 which in turn is made as an elastic pipe.

FIG. 12 shows an embodiment in which a plate 10 with which the oscillations are produced according to FIG. 1 is not located in the membrane 9, but in the rigid partition 7, and can be moved by means of a piston rod 11 or the like transversely to the lengthwise extension of the pipe.

FIG. 13 finally shows an embodiment of the invention in which plates 24 are movably located on opposing sides of the pipe 3. These plates are moved synchronously such that the lower plate 24 and the upper plate 24 move simultaneously and jointly up and down, by which in the fluid a corresponding flow or oscillation is produced which also is transmitted to the membrane 9.

FIGS. 10 and 11 show a pump as claimed in the invention in the form of a pipe 4 in a side view and an overhead view; the pipe is attached to the hull 21 of a ship via a holding device 20. The holding device 20 is used on the one hand to swivel the pipe 4, as is indicated in FIG. 11 by the arrow 22, and on the other hand to carry out the technically necessary means for producing the oscillations in the fluid. The pump action produces a fluid flow from the inlet 5 to the outlet 6 which of course causes the opposite motion of the ship.

As is apparent from the statements above and in conjunction with the attached drawings, it is important to the operation of the pump as claimed in the invention that one segment of the pipe has a delivery cross section which cannot be changed so that in it the oscillations produced in the fluid do not continue or do so only to a smaller extent than in the second segment with a variable delivery cross section in which transverse vibrations of the fluid are allowed. In this way the oscillations which run back and forth in the second segment in the lengthwise direction of the pipe are essentially reflected on the first segment (due to the inertia of the fluid and rigidity of the first segment) so that overall a flow in the pipe 4 occurs which flows from the inlet 5 to the outlet 6. If it cannot be avoided in the area of the outlet 6, especially for pipes with elastic outside walls, that it is clamped there and therefore there is also a short area there in which the delivery cross section cannot change, this does not contradict the idea of the invention if this section is so short that the oscillation or flow is not hindered to the extent as occurs through the first segment of the pipe.

It is important that the oscillation takes place in the vicinity of the abutting of the first and the second segment.

By suitable matching of the lengths and the delivery cross sections of the first and the second segment (the overall cross section of the first segment need not necessarily be the same size as the overall cross section of the second segment) and the frequency with which the oscillation is produced in the fluid, and the elasticity or the shape changing behavior of the second segment, the delivery behavior of the pump can be matched very well to the respective requirements. It is also possible to divide the overall cross section of the second segment not only into two, but also into several partial cross sections, by suitable excitation of the fluid in the individual partial cross sections almost pulse-free flow can be achieved. It is also possible to attach one or more lowpass elements following the outlet 6 in order to smooth the fluid flow. The use of higher oscillation frequencies likewise benefits the smoothing of the fluid flow.

Moreover, in the invention there is hardly any danger of injuries by mechanically moving parts; this makes the invention attractive for example as a drive for rescue boats. If the generated pressure fluctuations are not too large, water animals, such as fish and marine mammals, can be pumped without injury. It is also found that most constructions are very invulnerable to dirt and wear, and pumping for example with sludge- and rock-contaminated water is possible without damaging or clogging the pump.

It is also possible to convey gases by suitable dimensioning and adjustment of the pump.

In summary one embodiment of the invention can be described as follows:

A pump has a pipe 4 by which a fluid is conveyed, and a means 2 for producing transverse oscillations in a fluid. The pipe 4 on the inlet-side 5 has a first segment 1 with an invariable delivery cross section and on the outlet side 6 a second segment 3 with a variable delivery cross section.

The pump as claimed in the invention works according to the principle that the fluid when it is caused to oscillate in the second segment 3 with the variable delivery cross section can execute transverse oscillations and can propagate or flow in this way in this oscillatory system, conversely in the first segment 1 with an invariable delivery cross section an oscillation does not take place depending on the compressibility of the medium or takes place only to a much lesser extent. The waves in the oscillation produced in the fluid therefore will propagate largely in the direction of the second segment 3 with the variable delivery cross section so that flow of the fluid from the first segment 1 to the second segment 3 necessarily occurs.

The invention claimed is:

1. A pump comprising:

a pipe through which material is conveyed between an inlet and an outlet, said pipe having an upstream segment with a fixed delivery cross section, and a downstream segment with a variable delivery cross section;

a rigid partition that divides said upstream segment lengthwise;

an elastic partition that divides said downstream segment lengthwise and that has a downstream distal end that is attached to said outlet; and means for producing transverse oscillations in the material, said means for producing being located in an area in which said upstream segment is connected to said downstream segment, wherein lateral movement of said elastic partition is caused by oscillations of the material, and wherein said upstream segment has a length so that oscillations in the material in said downstream segment are reflected on the material in said upstream segment.

2. The pump of claim 1, wherein said means for producing transverse oscillations comprises a plate that is moved laterally in said pipe, said plate having an upstream edge flexibly attached to a downstream end of said rigid partition and having a downstream edge attached to an upstream distal end of said elastic partition.

3. The pump of claim 2, wherein only one said plate is between said rigid partition and said outlet.

4. The pump of claim 1, wherein said upstream segment is at least as long as said downstream segment.

* * * * *